United States Patent [19]

Herckelbout

[11] 4,147,048

[45] Apr. 3, 1979

[54] MACHINES FOR THE MANUFACTURE OF SPRINGS FITTED WITH EYELETS OR HOOKS

[76] Inventor: Jacques Herckelbout, 8, Rue Mirabeau, Paris 75, France

[21] Appl. No.: 921,406

[22] Filed: Jul. 3, 1978

Related U.S. Application Data

[63] Continuation of Ser. No. 806,636, Jun. 30, 1977, abandoned.

[30] Foreign Application Priority Data

Jun. 18, 1976 [FR] France ..... 76 18537

[51] Int. Cl.[2] ..... B21F 3/027; B21F 35/02

[52] U.S. Cl. ..... 72/137; 140/103

[58] Field of Search ..... 72/137, 142, 421, 422, 72/427; 140/103, 104; 214/1 BC

[56] References Cited

U.S. PATENT DOCUMENTS

| | | | |
|---|---|---|---|
| 2,809,675 | 10/1957 | Silko | 140/103 |
| 3,028,904 | 4/1962 | Halvorsen | 140/103 X |
| 3,032,076 | 5/1962 | Bonde et al. | 140/103 |
| 3,192,748 | 7/1965 | Lange | 140/103 X |
| 3,230,985 | 1/1966 | Kaufmann | 140/103 |

FOREIGN PATENT DOCUMENTS

| | | | |
|---|---|---|---|
| 2364718 | 7/1975 | Fed. Rep. of Germany | 72/422 |

*Primary Examiner*—E. M. Combs

*Attorney, Agent, or Firm*—William Anthony Drucker

[57] ABSTRACT

The invention relates to machines, for the manufacture of springs, of the type which produce springs with a hook in a plane passing through the axis of said spring at one end, and a hook lying in the extension of the last turn of the spiral at the other end. The improvement is that means are provided for transferring the roughed-out spring in front of a device, for straightening the second hook, which is angularly displaced in relation to the machine, the transfer being effected by an axial movement of the blank, followed by rotation, and ending with a further axial movement.

7 Claims, 11 Drawing Figures

MACHINES FOR THE MANUFACTURE OF SPRINGS FITTED WITH EYELETS OR HOOKS

This is a continuation of Ser. No. 806,636, filed June 30, 1977, abandoned.

BACKGROUND OF THE INVENTION

The present invention relates to improvements to machines designed to manufacture springs fitted at each end with a hook or an eyelet.

A machine produced by the applicant making it possible to produce a draw-spring fitted at each end with a means of hanging such as an eyelet or a hook, is already known.

The utility of this machine, known in the trade as the PR 101, lies in the possibility of forming two hooks during the production of the spring. A hook is first formed which is straightened to position it in the plane going through the axis of the usual winding spindle, then the spring is wound and, finally, the second hook is formed, which lies in the extension of the last turn of the spiral.

This machine does not enable the second hook to be straightened to bring it into the plane going through the axis of the spring. In fact, such an operation would call for additional tools to hold the spring and to tip the second hook backwards but the design of the machine, on the one hand, and the well-known principle used to wind the spring, on the other hand, do not enable said tools to be fitted or the second hook to be straightened.

STATE OF THE ART

In the present state of the art, it is therefore necessary to re-work all the springs one after another in order to complete the forming, i.e. to bring the second hook into a plane going through the axis of the spring.

SUMMARY OF THE INVENTION

The present invention, which overcomes these drawbacks, is noteworthy in that means are provided on the machine to grip the roughed-out spring, before cutting the wire, and transfer it, after cutting, in front of a straightening device angularly displaced in relation to the operative face of said machine, the transfer being effected by axial movement of said blank followed by rotation and ending with a further axial movement in order to position said blank in the centre of said straightening device, which comprises independent means of holding the blank during straightening.

BRIEF DESCRIPTION OF THE DRAWINGS

A better understanding of the present invention will be obtained from the description which follows, referring to the drawings wherein.

DESCRIPTION OF THE PREFERRED EMBODIMENT

Figure 1:
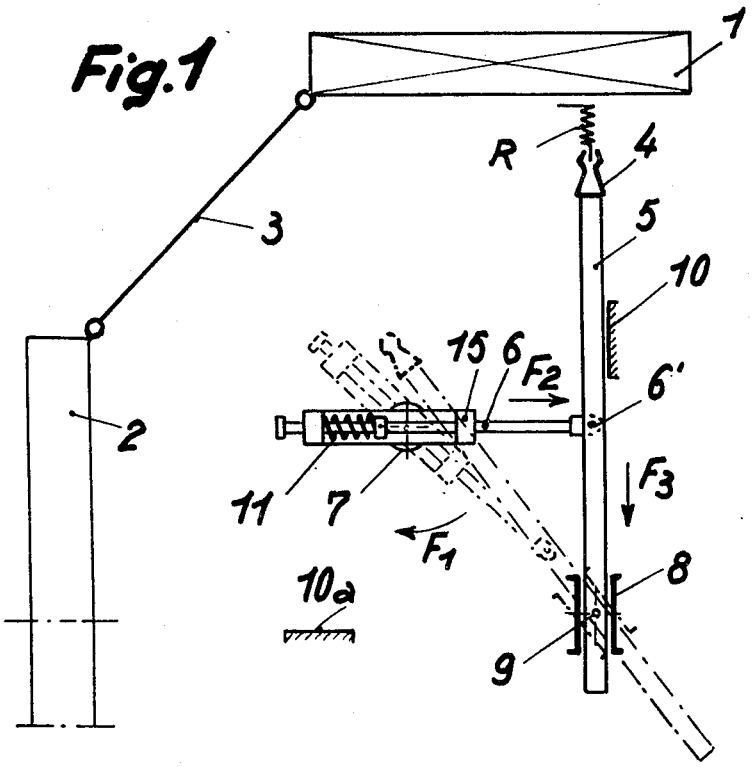
FIG. 1 is a view from above, very diagrammatical, showing in particular the transfer device in the position where it grips the blank of a spring.
Figure 2:
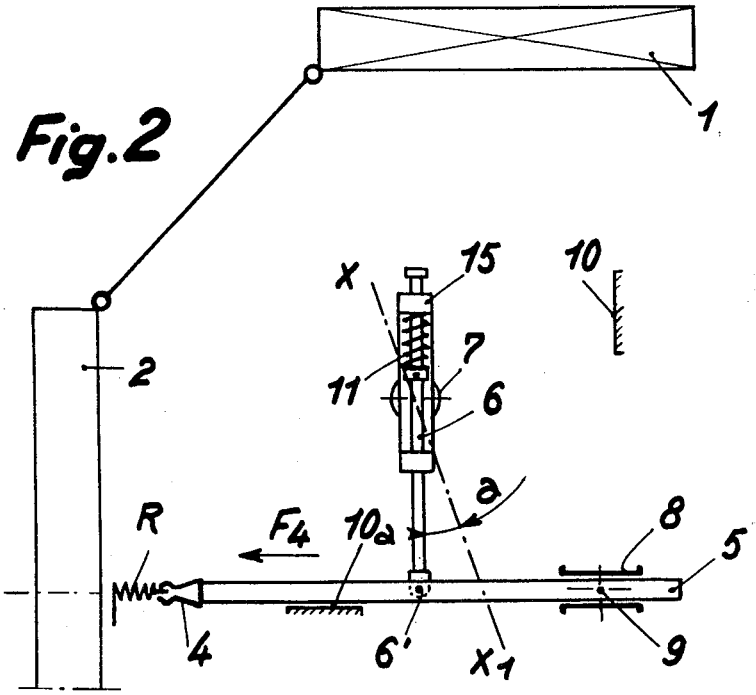
FIg. 2 is a similar view showing the same device at the end of the transfer.

Referring to FIGS. 1 and 2, reference 1 denotes a machine of known type making it possible to rough out a draw-spring R fitted at the front end with a straightened hook and, at the other end, with a hook lying in the extension of the last turn of the spiral, while 2 denotes a straightening device which is angularly displaced in relation to the machine 1, but is carried by the frame of the latter by means, e.g., of articulated arms 3 making it possible, in particular, to retract said device when it is not in use or to allow adjustment of the tools on the machine 1.

The problem consists of gripping the spring R before the wire is cut, which ordinarily causes it to fall, and placing it in the centre of the tools on the straightening device 2.

This result is obtained by means of a transfer device comprising a clamp 4 positioned at the end of a sliding and pivoting arm 5, driven by a crank 6 articulated on said arm at 6'. Crank 6 is keyed at the end of a shaft 7 and the sleeve 8 guiding the arm 5 is pivoted at 9.

It will thus be understood that if, from the position shown in full lines in FIG. 1, the crank 6 is pivoted in the direction of the arrow $F_1$, arm 5 can be brought to the position shown in FIG. 2.

In fact, the problem is more complicated since it is necessary that the withdrawal of the blank and its presentation to the straightening device be effected in a rectilinear trajectory so that said blank does not strike the various shaping tools.

Such a result is obtained by using a telescopic crank 6.

In each of the positions shown in FIGS. 1 and 2, arm 5 is applied against a stop 10 or 10*a* by the effect of the force stored in a spring 11 which tends to move crank 6 in the direction of arrow $F_2$.

When crank 6 pivots in the direction of arrow $F_1$, arm 5 slides in the direction of arrow $F_3$, continuing to bear against stop 10, this movement being continued until spring 11 is completely slackened. When spring 11 is completely slackened, continuation of the rotation of crank 6 then causes the rotation of arm 5.

When arm 5 comes up against stop 10*a*, crank 6 is in the position indicated by axis $X—X_1$, i.e. its rotation is not complete, it stil has an angle a to describe.

During this final rotation, spring 11 is compressed and arm 5 moves in the direction of arrow $F_4$, i.e. in a rectilinear trajectory.

The movements which have just been described above are reversed when the crank 6 rotates in the reverse direction.

A form of embodiment of this transfer device will now be described.

Figure 5:
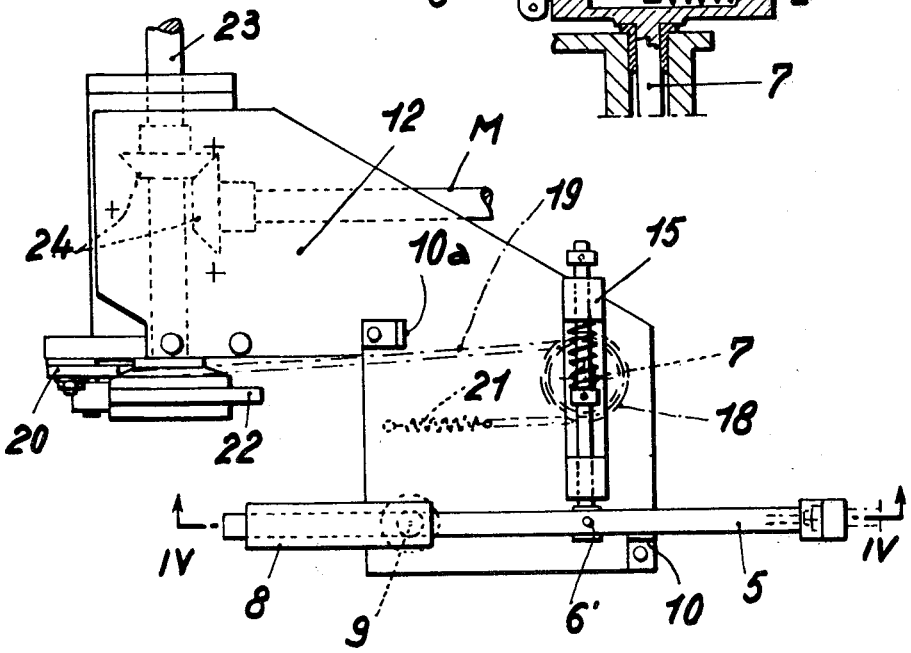
FIG. 5 is a plan view of FIG. 4.
Figure 7:
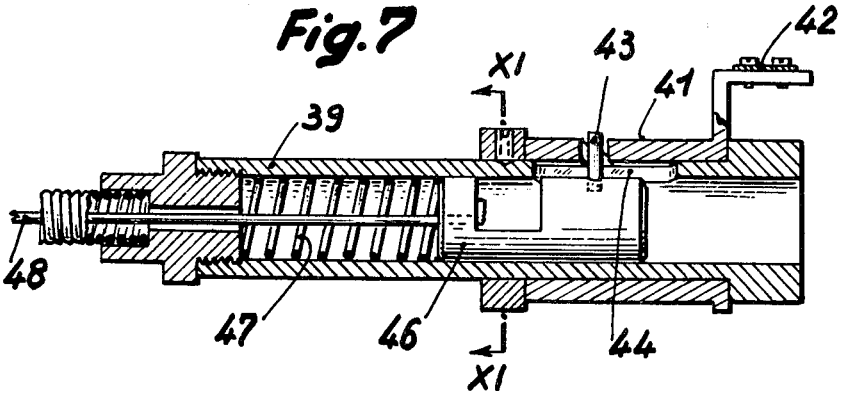
FIG. 7 is a longitudinal section view of a clamp used on the transfer device to grip a roughed-out spring.
Figure 8:
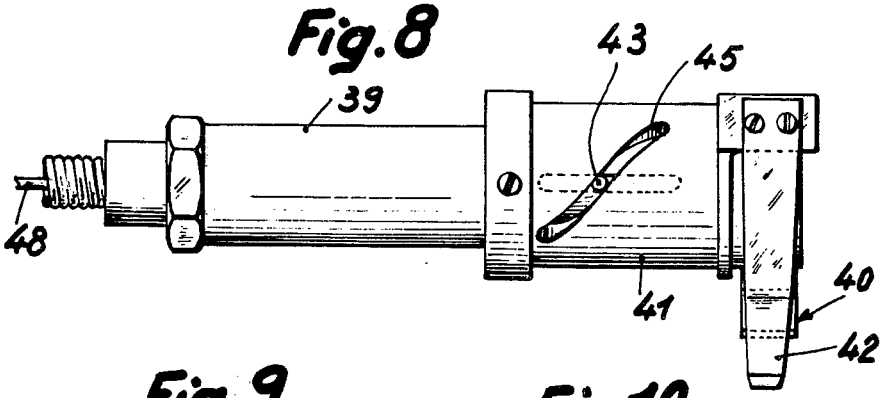
FIG. 8 is the view from above of FIG. 7.
Figure 9:
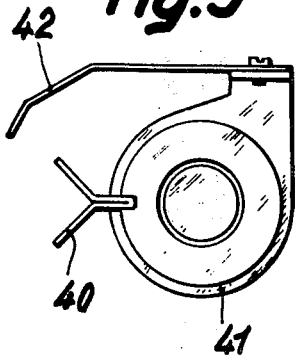
FIG. 9 is the end-on view of FIG. 7, with the clamp in the open position.
Figure 10:
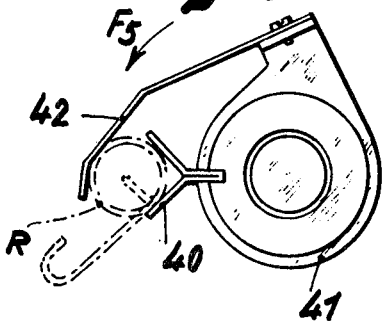
FIG. 10 is a similar view to the one in 9, with the clamp in the closed position.
Figure 11:
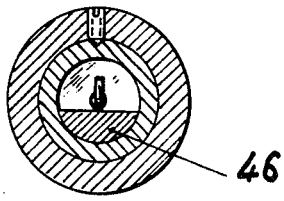
FIG. 11 is a sectional view along the line XI—XI in FIG. 7.

Arm 5 and crank 6 are carried by a plate 12 (see FIG. 5) comprising two bosses 13 and 14 in which pivot 9 supporting sleeve 8 and shaft 7 driving crank 6, respectively, swivel.

Shaft 7 is fixed to a stirrup 15 in the branches of which crank 6 can slide. Spring 11 is mounted on crank 6 and is interposed between a shoulder 16 on the latter and the inner face of the branch of the stirrup opposite arm 5. An adjustable stop 17 makes it possible to limit the slackening of spring 11 and, consequently, to fix the length of the rectilinear trajectory of arm 5.

A sprocket-wheel 18 is keyed to the lower end of shaft 7, on sprocket-wheel 18 is engaged a chain 19, fixed at one end to a lever 20 and at the other end to a fixed point of the plate with a return spring 21 interposed.

Figure 3:
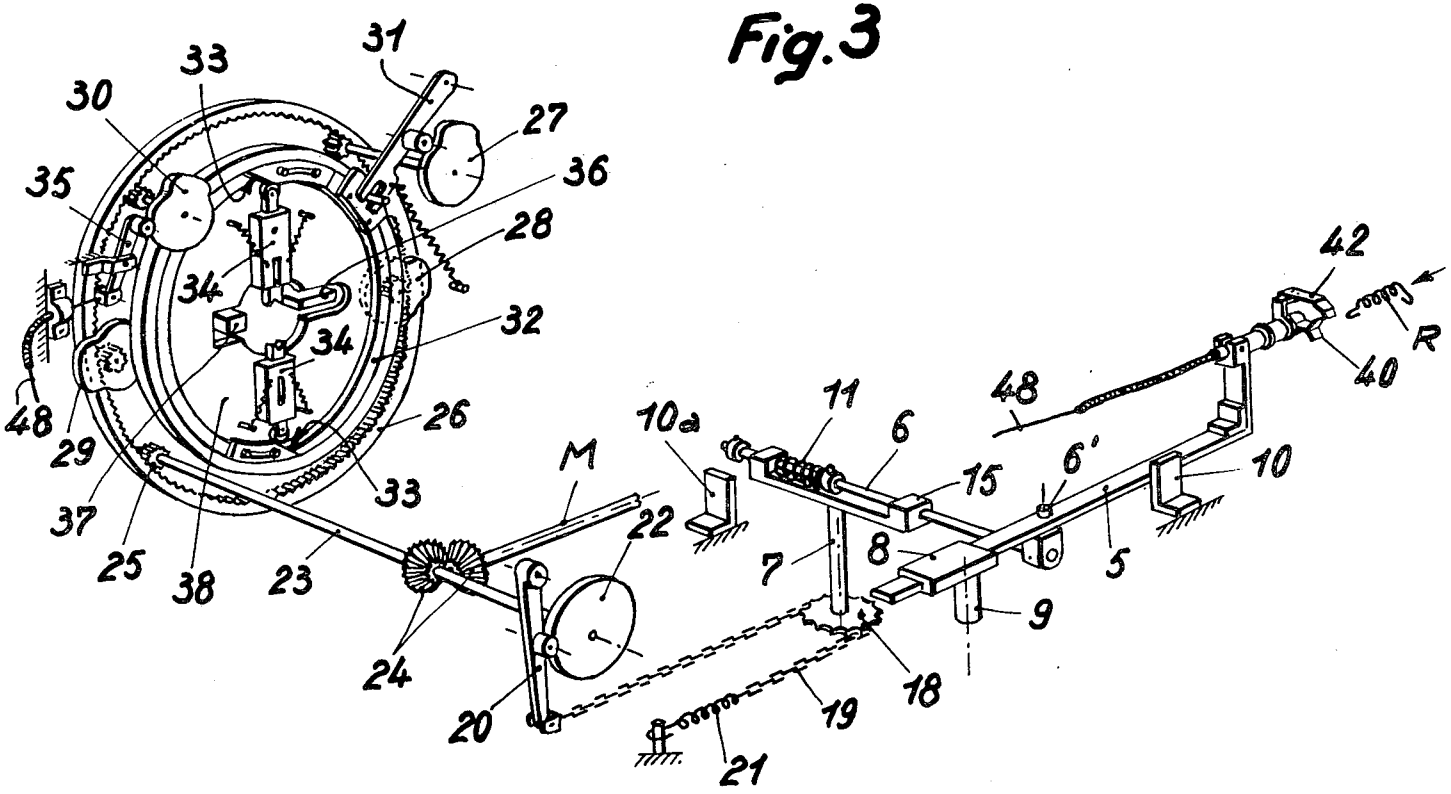
FIG. 3 is a diagrammatic perspective view, practically limited to the moving components, showing the drive means of the invention.
Figure 4:
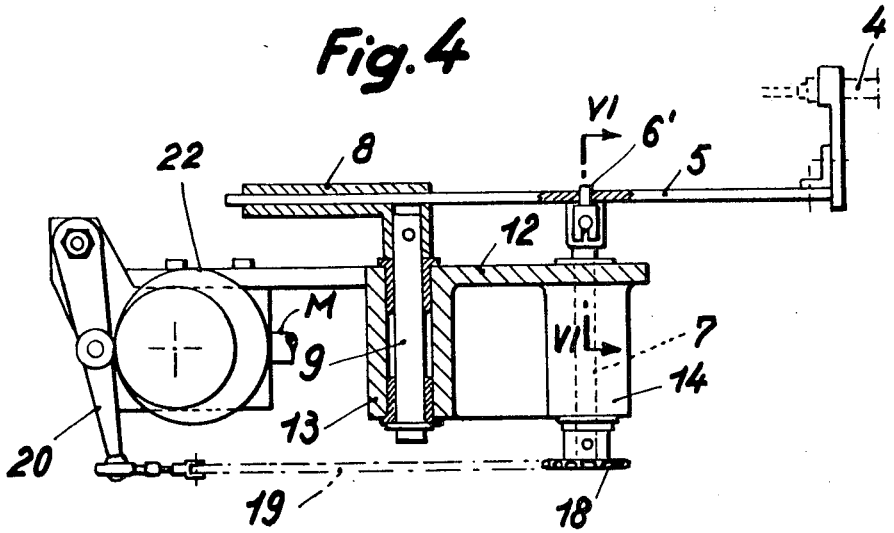
FIG. 4 is a section of the transfer device taken along the line IV—IV in FIG. 5.
Figure 6:
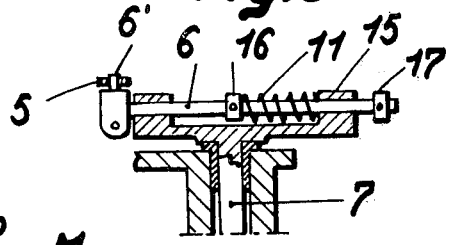
FIG. 6 is a sectional view along the line VI—VI in FIG. 4.

The pivoting of the lever is controlled by a cam 22 mounted at the end of a shaft 23, via a bevel gear consisting, e.g., of a couple of bevel pinions 24 (FIG. 3).

The driving shaft M of the couple 24 is part of machine 1.

Shaft 23 is fitted at the end with a pinion 25 engaging with a crown wheel, 26, internally toothed, on the straightening device.

Identical cam-driving pinions, e.g. 27, 28, 29 and 30, are meshed on this crown wheel.

Cam 27 causes the pivoting of a lever 31 driving a crown wheel 32 which has two ramps 33 diametrically opposite each other. Ramps 33 are used to move radially two slides 34 cooperating to form a clamp to hold the roughed-out spring during straightening.

Cams 28 and 29 are used to control the radial movement of the tool slides making it possible to carry out the straightening operation, or even another hook-forming operation.

Finally, cam 30 controls the pivoting of a lever 35 operating the cable which opens clamp 4.

It should be noted that the tool slides shown diagrammatically at 36 and 37 are mounted on a plate (not shown but positioned behind the plate 38 supporting slides 34) which can rotate around the axis of crown wheel 26.

A clamp which is particularly well suited to grip the roughed-out spring R (FIGS. 7 to 11) will now be described.

This clamp consists of a tubular body 39, the end of which comprises, at the side, a V-shaped piece 40, on which a sleeve 41 fitted with a side holdfast 42 can rotate.

Preferably, the V-shaped piece 40 and the holdfast 42 are made of a flexible material.

Rotation of sleeve 41 in the direction of arrow $F_5$ (FIG. 10) causes rotation of holdfast 42, which comes into position in front of V-shaped piece 40, holding spring R in the latter.

Rotation of sleeve 41 is caused by the movement of a finger 43 guided in a longitudinal slot 44 in body 39 and extending into a helical slot 45 in said sleeve.

Finger 43 is carried by a piston 46, sliding axially inside body 39, subjected to the effect of a spring 47 and connected to the free end of a sheathed cable 48, said cable being fixed at its other end to lever 35 operated by the aforementioned cam 30.

Port 45 is so arranged that closure of the clamp is obtained automatically by extension of spring 47.

Of course the present invention extends to all devices using structurally different means but which fulfill the same functions to achieve the same result.

I claim:

1. In a machine, for manufacturing helical wire springs having at one end a first hook positioned in a plane passing through the axis of the helix, and at the other end a second hook positioned in extension of the last turn of the helix, in combination:

(i) a spring-producing means adapted to produce an unfinished blank of the spring in a first position in which the axis of the helical spring coincides with a first line.

(ii) a means for straightening said second hook, said straightening means requiring the positioning of the unfinished blank in a second position in which the axis of the helical spring coincides with a second line in a common plane with, but at an angle to, said first line (iii) transfer means for gripping said unfinished blank in said first position and transferring it to said second position, said transfer means being arranged to carry out a linear movement away from said first position along said first line, then an angular movement from coincidence with said first line into coincidence with said second line, and then a linear movement along said second line into said second position.

2. A machine, as claimed in claim 1, wherein said transfer means comprises a sleeve rotatable about an axis normal to said common plane, an arm slidable radially in said sleeve, gripper means at an end of said arm, a first stop means positioned for abutment by said arm when the arm is in said first position, second stop means positioned for abutment by said arm when the arm is in said second position, a crank rotatable about an axis normal to said plane and telescopically variable in radial length, said crank being coupled to said arm remote from the axis of rotation of the arm, and means for rotating said crank.

3. A machine as claimed in claim 2, wherein said crank comprises a stirrup rotatable about said crank axis, a crank arm slidable radially in said stirrup, spring means acting between said stirrup and said crank arm to urge the crank arm in radially outwards direction, a sprocket wheel coupled to said stirrup, a chain meshed with said sprocket wheel and having a first end coupled to a spring connected to a fixed part of the machine, said chain having its other end connected to a pivoted lever, rotatable cam means abutting said lever, and means for rotating said cam means.

4. A machine, as claimed in claim 1, comprising a drive shaft common to said straightening means and to said transfer means.

5. A machine, as claimed in claim 4, wherein said straightening means includes:

(a) means for releasably holding the unfinished blank (b) tool means for acting on the unfinished blank held by said holding means to straighten said second hook (c) a plurality of rotatable cams respectively coupled to said holding means and said tool means for actuation thereof, (d) a respective pinion coupled to each said cam (e) an internally toothed crown wheel meshed with all of said cams (f) a drive pinion meshed with said crown wheel and mounted on said common shaft.

6. A machine, as claimed in claim 1 wherein said transfer means includes gripper means for gripping the unfinished blank, said gripper means having a body with a radially projecting V-shaped element in which the unfinished blank can seat, a sleeve rotatable on said body, and a holdfast element carried by said sleeve and adapted, upon rotation of said sleeve, to abut against said blank and hold it in the V-shaped element.

7. A machine, as claimed in claim 6, wherein said body includes an axial slot, and wherein said sleeve includes a helical slot, and wherein means for rotation of said sleeve with respect to said body comprise an actuating member slidable axially in said body and having a radially projecting finger engaged into the slot of the body and the slot of the sleeve, a spring in said body acting on said actuating member to urge it in a first axial direction, and a cable coupled to said actuating member for pulling it in a second axial direction against said spring.

* * * * *